United States Patent [19]

Putman et al.

[11] Patent Number: 4,648,241

[45] **Date of Patent: * Mar. 10, 1987**

[54] ACTIVE CLEARANCE CONTROL

[75] Inventors: Robert L. Putman, Bolton; Merle L. Dinse, S. Windsor, both of Conn.

[73] Assignee: United Technologies Corporation, Hartford, Conn.

[ * ] Notice: The portion of the term of this patent subsequent to Mar. 18, 2003 has been disclaimed.

[21] Appl. No.: 548,467

[22] Filed: Nov. 3, 1983

[51] Int. Cl.[4] ..... F02C 7/18

[52] U.S. Cl. ..... 60/39.29; 415/115

[58] Field of Search ..... 60/39.07, 726, 39.29, 60/39.83; 415/115, 116, 108, 126–128, 177–180, 415/144, 145, 175, 176

[56] References Cited

U.S. PATENT DOCUMENTS

| | | | |
|---|---|---|---|
| 2,837,270 | 6/1958 | Chapman | 415/145 |
| 2,848,156 | 8/1958 | Oppenheimer | 415/108 |
| 3,031,132 | 4/1962 | Davies | 415/115 X |
| 3,647,313 | 3/1972 | Koff | 415/116 X |
| 3,742,706 | 7/1973 | Klompas | 415/115 X |
| 3,844,110 | 10/1974 | Widlansky et al. | 60/39.08 |
| 3,945,759 | 3/1976 | Bobo | 415/145 |
| 4,127,988 | 12/1978 | Becker | 60/726 |
| 4,230,436 | 10/1980 | Davison | 415/175 X |
| 4,268,221 | 5/1981 | Monstrrat et al. | 415/175 X |
| 4,329,114 | 5/1982 | Johnston et al. | 415/116 X |

*Primary Examiner*—Louis J. Casaregola

*Attorney, Agent, or Firm*—Norman Friedland

[57] ABSTRACT

Active clearance control is effectuated by heating the bore of the high pressure compressor spool so as to expand the compressor disc and labyrinth seals to minimize the gap between the blades and its peripheral seal and labyrinth seal. The high stages of the high spool compressor are selectively bled to achieve the desired gap control over the engine's operating envelope. The bled air is fed into the bore by conducting the air externally of the engine's case and admitting it through hollow stator vanes of the low pressure spool and tubes communicating with a cavity at the bearing supporting the high pressure compressor shaft at a juncture in line with the inlet of the high pressure compressor spool.

2 Claims, 1 Drawing Figure

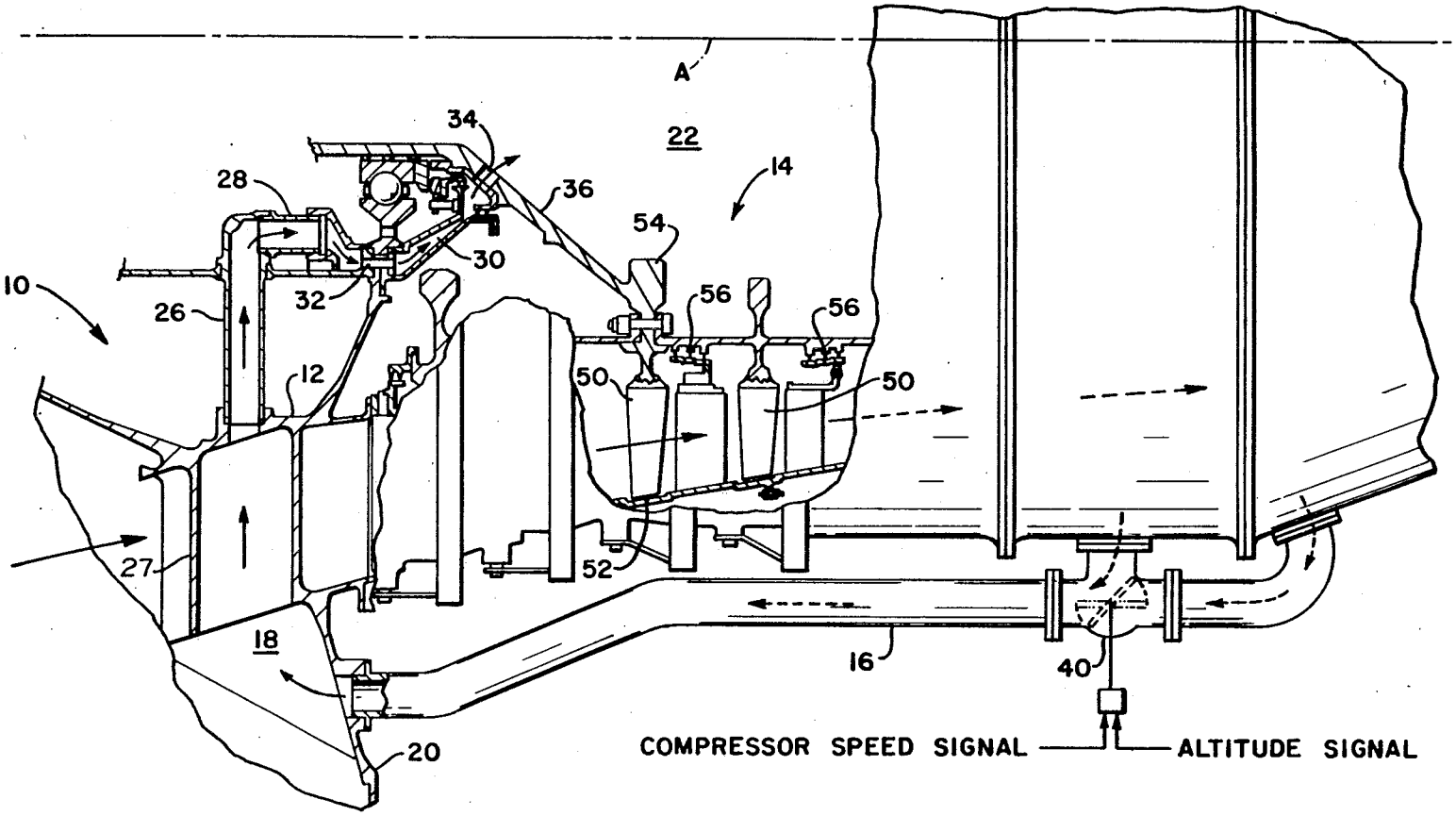
ALTITUDE SIGNAL
COMPRESSOR SPEED SIGNAL
40
16
50
56
14
22
A
54
36
34
30
32
28
26
10
12
27
18
20
52

ACTIVE CLEARANCE CONTROL

CROSS REFERENCE

This invention is related to the inventions disclosed in copending patent application entitled ACTIVE CLEARANCE CONTROL filed by Harvey I. Weiner and Kenneth L. Allard on Nov. 3, 1983 and assigned to the same assignee of this application.

TECHNICAL FIELD

This invention relates to gas turbine engines and particularly to an active clearance control for controlling the clearance between the tips of the axial compressor blades and their attendant peripheral seals.

BACKGROUND ART

As is well known, the aircraft engine industry has witnessed significant improvements in thrust specific fuel consumptions (TSFC) by incorporating active clearance controls on the engines. As for example, the JT9D engine manufactured by Pratt & Whitney Aircraft of United Technologies Corporation, the assignee of this patent application, has been modified to include the active clearance control described and claimed in the Redinger et al U.S. Pat. No. 4,069,662 also assigned to this assignee. In that embodiment spray bars are wrapped around the engine case at judicious locations and fan air is actuated to impinge on the engine case so as to cool and hence shrink the case and move the outer air seals, which are attached thereto, toward the tips of the turbine blade. As is referred to in the industry, this is an active clearance control system since the impinging air is only on during certain modes of the engine operating envelope. This is in contrast to the passive type of system that continuously flows air for cooling certain engine parts.

With the utilization of the active clearance control at given locations in the engine, the performance of the engine has increased by more than two (2) percentage points in terms of TSFC. Obviously, it is desirable to minimize the gap of all the rotating blades, since any air escaping around the blades is a penalty to the overall performance of the engine.

This invention is directed to an active clearance control for the compressor blades and operates internally of the engine, rather than externally. Also, this invention contemplates heating the bore of the compressor so as to cause the blades to expand toward the peripheral seals so as to minimize the gap therebetween. Compressor bleed air which is at a higher pressure and temperature than the incoming air is conducted into the bore of the compressor in proximity to the engine's centerline where it scrubs the compressor discs and flows rearwardly to commingle with the working fluid medium. This air may also be utilized for other cooling purposes on its travel toward the exit end of the engine. As for example, this air may be utilized for cooling or buffering the bearing compartment.

This invention contemplates judiciously bleeding the 9th and 13th stage of the multistages of the compressor and leading this air forward of the compressor where it is introduced at the most forward end of the compressor adjacent the engine centerline. The cooler air from the 9th stage is introduced at takeoff and the warmer air from the 13th stage is introduced at cruise. Inasmuch as the warmer air causes thermal growth of the compressor discs, the blade tip gaps are reduced with a consequential improvement in engine performance.

DISCLOSURE OF INVENTION

One object of this invention is to provide for a gas turbine engine improved active clearance control by compressor bore heating techniques. A feature of this invention is to bleed from a downstream stage, compressed air and feed it into the bore at the inlet of the high compressor of a twin spool gas turbine engine. A lower temperature is fed into the bore at preselected times of the engines operating envelope so as to avoid overheating of the compressor components. At cruise condition of the aircraft powered by said engine, the hotter air is introduced into the bore so as to expand the compressor discs and blades to move the tips of the blades closer to the peripheral seal. Air from the bleeds are fed through a stator or several stators, made hollow, located in the low pressure spool of a twin spool engine through the bearing support of the high pressure spool shaft into the bore adjacent the inlet of the high pressure compressor spool.

Other features and advantages will be apparent from the specification and claims and from the accompanying drawings which illustrate an embodiment of the invention.

BRIEF DESCRIPTION OF DRAWINGS

The sole FIGURE is a schematic view showing a portion of the high spool compressor of a twin spool gas turbine engine configuration.

BEST MODE FOR CARRYING OUT THE INVENTION

As can be seen from the sole FIGURE, the high pressure compressor of a twin spool gas turbine engine is partially shown. However, for further details of the construction of this type of engine reference should be made to the model JT9D or PW2037 engines manufactured by Pratt & Whitney Aircraft of United Technologies Corporation, the assignee of this patent application. As is conventional, air from the low pressure compressor of the low pressure spool 10 flows over the vane 12 into the high pressure compressor spool 14 (only a portion being shown) and continues to flow to the multiple stages prior to being admitted to the combustion section.

In accordance with this invention compressed air bled from the 9th and/or 13th compressor stages of the high pressure spool is directed forward of the engine through conduit 16 to a cavity 18 in the engine casing 20. Several of a plurality of circumferentially spaced vanes (only one being shown) communicate with cavity 18 to direct the bled compressor air toward the engine's centerline A in the bore 22 of the compressor. As can be seen, the compressor bled air flows radially inward through low pressure compressor hollow stator vane 27 pipe 26 and then rearwardly through pipe 29 and between the existing bearing support 28 and compartment 30. Openings 32 and 34 are formed in the bearing support 28 and the high pressure shaft case 36 for leading the compressor bled air into the bore 22.

During high powered engine operation, such as takeoff of the aircraft only the cooler compressor bled air is directed into bore 22 to assure that the blade discs do not thermally grow to rub the outer air seals. During cruise operation the high temperature air from the 13th compressor stage is added to the 9th stage to increase the compressor bleed temperature being fed into a bore 22. This, obviously, serves to heat the compressor discs to cause them to expand and move closer to the outer air seals.

As can be seen from the sole FIGURE the blades 50 of the high pressure compressor spool are surrounded by peripheral seal 52 and the gap is closed or minimized by the heating of the compressor disc 54, likewise the labyrinth seals 56 are heated and will also have a minimal gap.

Valve 40, schematically shown, can be any well known valve that operates on a given engine and/or aircraft parameter, say compressor speed and aircraft altitude, to assure that the hotter air is admitted into the bore of the compressor during aircraft cruise. A suitable control system is shown in the Redinger et al U.S. Pat. Nos. 4,069,662 and 4,019,320 granted on Jan. 24, 1978 and Apr. 26, 1977 respectively and incorporated herein by reference.

It should be understood that the invention is not limited to the particular embodiments shown and described herein, but that various changes and modifications may be made without departing from the spirit and scope of this novel concept as defined by the following claims.

We claim:

1. An active clearance control system for a twin spool gas turbine power plant operating over an engine operating envelope including a cruise mode having a plurality of stages of axial flow compressors defining the high pressure compressor spool and the low pressure compressor spool powering aircraft, each compresor stage having a stator including circumferentially spaced vanes, a disc supporting a plurality of compressor blades and an outer air seal, said compressor stages rotatably supported in an engine case to a shaft supported by bearings, said bearings being in proximity to the entrance of the high pressure spool of said compressor stages, means for selectively bleeding air from separate compressor stages in the high pressure compressor spool, and means including an external conduit and tube means for leading said bled air into the bore of said high pressure spool, through an opening in the engine's casing, a hollow stator vane in the low pressure compressor spool, through said bearing and said high pressure spool shaft and means responsive to engine operating parameters for controlling said selective bleeding means so as to introduce air into said bore from the hottest stage of said bleeding stages during the cruise mode of said power plant.

2. An active clearance control as in claim 1 wherein said selective bleeding means is a valve disposed in said external conduit.

* * * * *